US007408293B2

(12) United States Patent
Francesconi et al.

(10) Patent No.: US 7,408,293 B2
(45) Date of Patent: Aug. 5, 2008

(54) SPARK PLUG INCLUDING GROUND ELCETRODE CARRIER CASING

(75) Inventors: Christian Francesconi, Bruck a.d. Mur (AT); Christoph Egger, Jenbach (AT)

(73) Assignee: GE Jenbacher GmbH & Co OHG, Jenbach (AT)

( * ) Notice: Subject to any disclaimer, the term of this patent is extended or adjusted under 35 U.S.C. 154(b) by 0 days.

(21) Appl. No.: 10/945,821

(22) Filed: Sep. 20, 2004

(65) Prior Publication Data

US 2005/0062386 A1 Mar. 24, 2005

(30) Foreign Application Priority Data

Sep. 19, 2003 (AT) ..... A 1485/2003

(51) Int. Cl.
*H01T 13/00* (2006.01)
*H01T 13/20* (2006.01)

(52) U.S. Cl. ..... 313/143; 313/118; 313/144

(58) Field of Classification Search ..... 313/143, 313/135

See application file for complete search history.

(56) References Cited

U.S. PATENT DOCUMENTS

| | | | | |
|---|---|---|---|---|
| 3,958,144 | A * | 5/1976 | Franks | 313/138 |
| 4,491,101 | A * | 1/1985 | Strumbos | 313/118 |
| 4,540,910 | A * | 9/1985 | Kondo et al. | 313/11.5 |
| 5,017,826 | A | 5/1991 | Oshima et al. | 313/142 |
| 5,493,171 | A | 2/1996 | Wood, III et al. | 313/141 |
| 2002/0067111 | A1 * | 6/2002 | Shibata et al. | 313/141 |
| 2004/0070323 | A1 * | 4/2004 | Francesconi et al. | 313/140 |

FOREIGN PATENT DOCUMENTS

| | | |
|---|---|---|
| EP | 0 020 200 | 12/1980 |
| GB | 2 327 459 | 1/1999 |
| JP | 2000-068030 A | 3/2000 |

* cited by examiner

*Primary Examiner*—Sikha Roy
*Assistant Examiner*—Natalie K Walford
(74) *Attorney, Agent, or Firm*—Wenderoth, Lind & Ponack, L.L.P.

(57) ABSTRACT

A spark plug, in particular for use in internal combustion engines, includes a spark plug casing and a ground electrode carrier casing. The ground electrode carrier casing has at least two ground electrode carrier casing portions having mutually different materials and/or the ground electrode carrier casing is of a different material from the spark plug casing.

25 Claims, 2 Drawing Sheets

SPARK PLUG INCLUDING GROUND ELCETRODE CARRIER CASING

BACKGROUND OF THE INVENTION

The present invention concerns a spark plug, in particular for use in internal combustion engines, comprising a spark plug casing and a ground electrode carrier casing. The invention also concerns a process for the production of such a spark plug.

The spark plugs which are known in the state of the art have a ground electrode carrier casing with which the spark plug is inserted, for example, into the cylinder head of an internal combustion engine. In most cases, the ground electrode carrier casing is provided at its outside surface with a screwthread with which the spark plug can be screwed into the cylinder head. However, spark plugs with smooth cylindrical ground electrode carrier casings are also known, and these spark plugs are clamped into the cylinder head or are fixed thereto, for example, by a bayonet fixing. One or more ground electrodes are provided at the combustion chamber end of the ground electrode carrier casing. The ground electrode carrier casing itself is made in one piece with the rest of the spark plug casing, or is welded thereto by resistance welding methods. In the case of the spark plugs known in the state of the art, the combustion chamber end of the ground electrode carrier casing frequently involves problems with the extremely high temperatures there. The situation repeatedly involves hot corrosion in the region of the ground electrode carrier casing and thus gives rise to adverse impairment or destruction of the spark plug.

In the state of the art shown in FIG. 1, the spark plug has an insulator body 1 and a spark plug casing 2 enclosing the body 1. The ground electrode carrier casing 3 is generally connected integrally or by resistance welding to the spark plug casing 2. In the commercially available standard spark plug shown in FIG. 1, the ground electrode carrier casing 3 carries the screwthread 9 with which the spark plug is screwed, for example, into the cylinder head of an internal combustion engine. Arranged at the combustion chamber end 10 of the ground electrode carrier casing 3, which is located at the combustion chamber side or which faces towards the combustion chamber, is a hook electrode 4 serving as the ground electrode. Arranged to oppose the end of the hook electrode 4, the central electrode 5 projects out the insulator body 1. The connecting contact 7 is provided for connecting the central electrode 5, which is guided in the insulator body 1, to an ignition plug (not shown).

SUMMARY OF THE INVENTION

Therefore, the object of the invention is to provide a spark plug in which hot corrosion of the ground electrode carrier casing is prevented. In accordance with the invention, the object is achieved in that the ground electrode carrier casing has at least two ground electrode carrier casing portions having mutually different materials and/or the ground electrode carrier casing is made of a different material than the spark plug casing.

In accordance with the invention, provided in the region in which the greatest production of heat occurs at the ground electrode carrier casing is a special material which effectively prevents hot corrosion. In that case, the remaining structure of the spark plug can be of the previously known form and can be implemented using the materials which are also hitherto usual, and thus is generally inexpensive. In that respect, there is the option of making both a part of the ground electrode carrier casing and also the entire ground electrode carrier casing from a different material than the spark plug casing or the other part, which has remained thereon, of the ground electrode carrier casing.

A suitable process for the production of a spark plug according to the invention provides that the ground electrode carrier casing is provided with at least two ground electrode carrier casing portions. The portions are of different materials and/or the ground electrode carrier casing is made from a different material than the spark plug casing. In a particularly inexpensive fashion, a spark plug according to the invention can be produced starting from a commercially available spark plug if, on a commercially available spark plug comprising a ground electrode carrier casing at the end thereof (which in the position of installation faces towards a combustion chamber), a part of the ground electrode carrier casing or the entire ground electrode carrier casing and possibly the ground electrode or ground electrode arrangement present there is removed and then a ground electrode carrier ring is fitted onto or welded to the remaining part of the ground electrode carrier casing or the spark plug casing of the commercially available spark plug. The ground electrode carrier ring is of a different material from the remaining part of the ground electrode carrier casing or the spark plug casing of the commercially available spark plug.

BRIEF DESCRIPTION OF THE DRAWINGS

Further details and features of the present invention will be apparent from the specific description provided hereinafter made with reference to the drawings, in which.

DETAILED DESCRIPTION OF THE INVENTION

In the following description, some of the same reference numbers used to describe a conventional spark plug above are also used to identify like components in the present invention.

Figure 1:
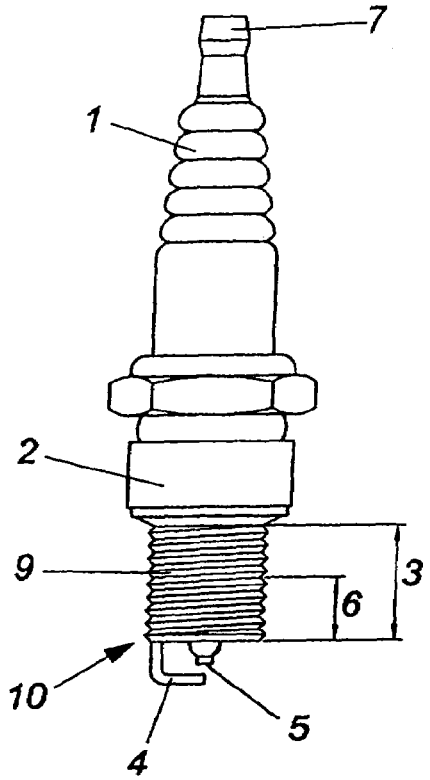
Fig. 1 prior art
FIG. 1 is a side view of a conventional spark plug in accordance with the state of the art.
Figure 2:
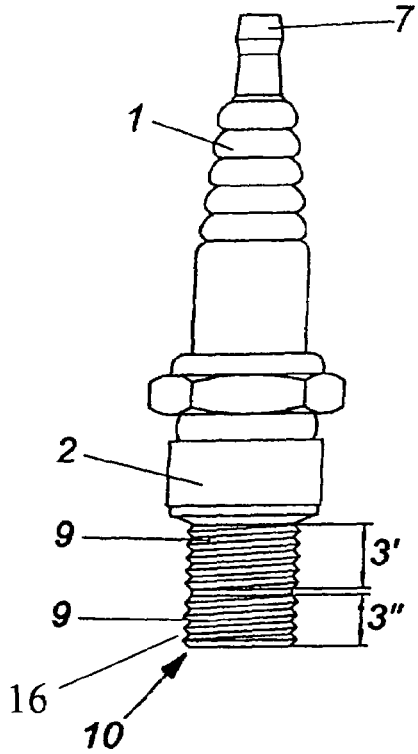
FIG. 2 is a side view of a variant in accordance with the invention of a spark plug.

In the state of the art, the ground electrode carrier casing 3 and the spark plug casing 2 are made from one and the same material. However, a first variant of the present invention, as FIG. 2 shows, provides at least two different ground electrode carrier casing portions 3' (first portion) and 3" (second portion) which are made of mutually different material. In the illustrated embodiment, both ground electrode carrier casing portions 3' and 3" carry a screwthread 9. It is, however, also possible for only one portion 3' or 3" or no portion to carry a screwthread 9. In the illustrated case, the spacing between the two portions 3' and 3" is selected so that both portions can be screwed together into a standard female screwthread. In order to prevent hot corrosion, the second ground electrode carrier casing portion 3" which faces (i.e., is closest to the combustion chamber desirably involves a higher level of thermal conductivity than the first ground electrode carrier casing portion 3', whereby the heat which occurs at the combustion chamber end 10 can be quickly dissipated. In the illustrated embodiment, the second ground electrode carrier casing portion 3" at the combustion chamber side is in the form of a ring fitted onto or welded to the first ground electrode carrier casing portion 3'. An advantageous process for that purpose involves starting with the commercially available standard spark plug as shown in FIG. 1. Firstly an end region 6 of the ground electrode carrier casing 3 together with the ground hook electrode 4 is removed therefrom, and then a ground electrode carrier ring 16 of a different material is fitted onto the first ground electrode carrier casing portion 3' which has remained in the commercially available spark plug and is desirably welded thereto. Thus, the carrier ring 16 becomes the second ground electrode carrier casing portion 3". In a second variant according to the invention, the entire ground electrode carrier casing 3 comprises a different material from the spark plug casing 2. In a production process which is otherwise similar to the above-depicted process, then not only a part of the ground electrode carrier casing 3 but the entire ground electrode carrier casing 3 of the standard spark plug is removed and replaced by a ground electrode carrier ring 16 of a different material. The ring 16 is again welded to the spark plug casing 2. In both variants, a pulsed or unpulsed laser welding process is a preferred welding process.

The second ground electrode carrier casing portion 3" which, in the position of installation of the spark plug, faces towards a combustion chamber carries a ground electrode 8 or a ground electrode arrangement. In that respect, a spark plug which is particularly operationally resistant is achieved if the ground electrode 8 or the ground electrode arrangement is arranged substantially in the interior of the second ground electrode carrier casing portion 3" or the ground electrode carrier casing 3, which in the position of installation of the spark plug faces (is closest to) a combustion chamber. That is shown by way of example in FIG. 3. In that case, the integrated ground electrode 8 is disposed in the interior of the second portion 3", and it is desirably made from the same material as the portion 3" and can be made in one piece therewith. The screwthread 9 or the wall of the ground electrode carrier casing 3 or its second portion 3" which is closest to the combustion chamber desirably projects beyond the spark location 12 (see FIG. 4). In particular, making the ground electrode 8 in one piece with the ground electrode carrier casing 3 or its second portion 3" closest to the combustion chamber provides for optimum heat dissipation from the immediate ignition location into the mounting means of the spark plug (for example the screwthread of a cylinder head).

As is known per se, the central electrode 5 and/or the ground electrode 8 can carry a small electrode plate portion 11, preferably of noble metal, as the electrode. It is particularly advantageous if the second ground electrode carrier casing portion 3" which is closest to the combustion chamber or the entire ground electrode carrier casing 3 has a nickel-base alloy or a nickel-chromium alloy. Besides nickel and chromium, it may also include at least one of the elements aluminum, titanium, niobium, cobalt, copper, molybdenum, tungsten or iron. A particularly preferred nickel-based alloy is the material marketed under the trade name "Inco Alloy 600"* No: 2.4816. The spark plug casing 2 and the first portion 3' which is optionally present in the ground electrode carrier casing 3 can be made from the hitherto usual, generally less expensive materials.

Figure 3:
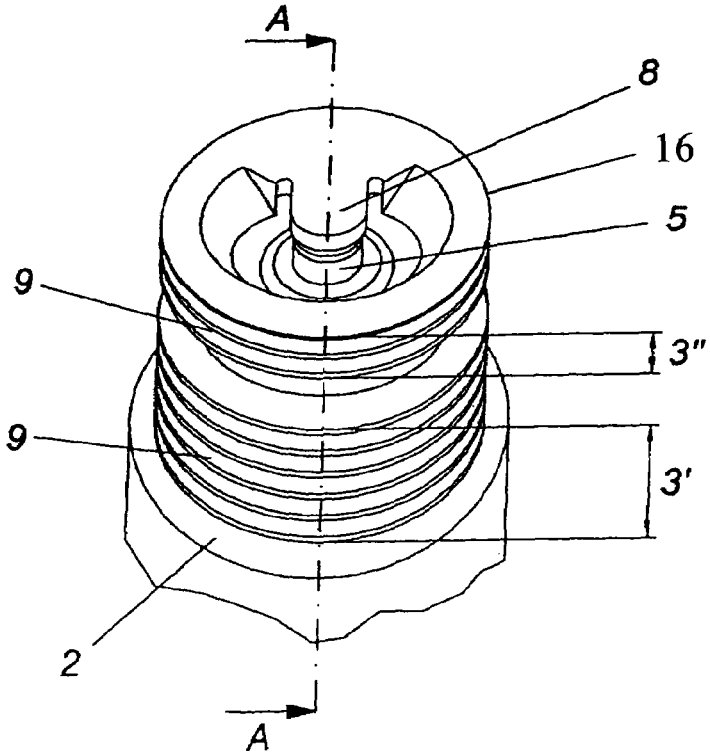
FIG. 3 is a perspective view of the combustion chamber end of the spark plug according to the invention shown in FIG. 2 in a first embodiment.
Figure 4:
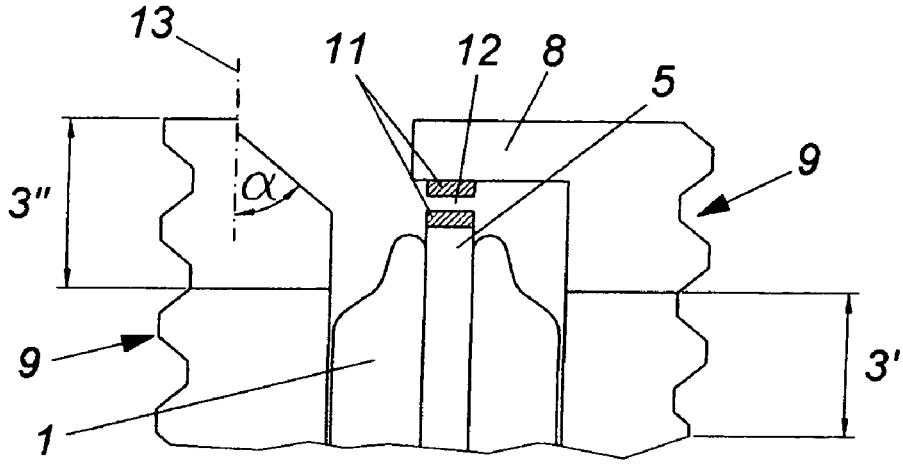
FIG. 4 is a view in section through the upper part of the ground electrode carrier casing as shown in FIG. 3 taken along section line AA.

FIG. 4 shows a section taken along line AA of FIG. 3, through the combustion chamber end of the ground electrode carrier casing 3. Besides the integral configuration of the ground electrode 8 with the second portion 3" as already discussed above, and the provision of small electrode plate portions 11 (preferably of noble metal), accessibility of the fuel mixture to the spark location is improved by the wall of the second portion 3" or the ground electrode carrier casing 3 which surround the ground electrode 8. The wall is inclined at least in a region-wise manner towards the ground electrode 8 at an angle of between 100 and 60° relative to a line 13 parallel to the central electrode 5 of the spark plug. Angles of inclination of about 30° are preferred in the sense of affording particularly optimum accessibility for the fuel mixture to the spark location 12.

Figure 5:
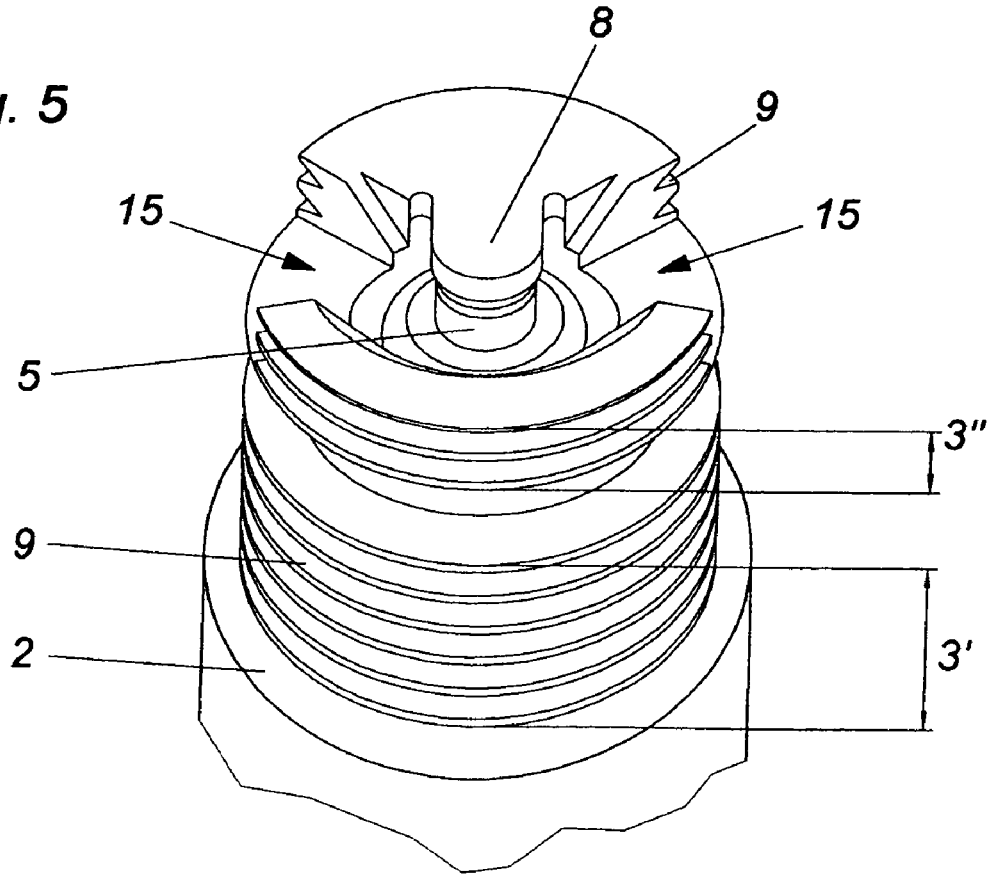
FIG. 5 is a perspective view of a further variant of the combustion chamber end of a spark plug according to the invention.

A further improvement in accessibility of the fuel mixture to the spark location 12 is achieved as shown by way of example in FIG. 5 by recesses 15 at the combustion chamber end of the second portion 3" or the ground electrode carrier casing 3.

Although in the illustrated embodiments, by way of example, the ground electrode carrier casing 3 and the portions 3' and 3" thereof each carry a respective screwthread 9, the invention is not restricted to such spark plugs. The invention can also be embodied in spark plugs in which the ground electrode carrier casing 3 does not have a screwthread 9 and/or is of a different configuration. In addition the most widely varying ground electrode configurations are possible.

Besides the illustrated two portions 3' and 3", the ground electrode carrier casing 3 may also have further portions with once again other materials.

The invention claimed is:

1. A spark plug comprising:

a spark plug casing; and a ground electrode carrier casing including a first ground electrode carrier casing portion and a second ground electrode carrier casing portion, each of said first ground electrode carrier casing portion and said second ground electrode carrier casing portion having a screwthread, said first ground electrode carrier casing portion being made from a material different than said second ground electrode carrier casing portion.

2. The spark plug of claim 1, wherein said second ground electrode carrier casing portion faces a combustion chamber of an engine when said spark plug is installed in the engine, said second ground electrode carrier casing portion having a higher thermal conductivity than said first ground electrode carrier casing portion.

3. The spark plug of claim 1, wherein said ground electrode carrier casing has a higher thermal conductivity than said spark plug casing.

4. The spark plug of claim 1, wherein said second ground electrode carrier casing portion faces a combustion chamber of an engine when said spark plug is installed in the engine, said second ground electrode carrier casing portion being in the form of a ring fitted onto or welded to said first ground electrode carrier casing portion.

5. The spark plug of claim 1, wherein said second ground electrode carrier casing portion faces a combustion chamber of an engine when said spark plug is installed in the engine, said second ground electrode carrier casing portion carrying a ground electrode.

6. The spark plug of claim 5, wherein said second ground electrode carrier casing portion is integrally formed as one piece with said ground electrode.

7. The spark plug of claim 5, wherein said ground electrode is arranged substantially in an interior of said second ground electrode carrier casing portion.

8. The spark plug of claim 7, wherein a wall of said second ground electrode carrier casing portion surrounds said ground electrode, at least a portion of said wall has a surface inclined towards said ground electrode at an angle in a range of between 100 and 60° relative to a line parallel to a central electrode of said spark plug.

9. The spark plug of claim 1, wherein said second ground electrode carrier casing portion faces a combustion chamber of an engine when said spark plug is installed in the engine, said second ground electrode carrier casing portion comprises a nickel-based alloy or a nickel-chromium alloy.

10. The spark plug of claim 9, wherein said second ground electrode carrier casing portion comprises said nickel-chromium alloy and further comprises at least one of the elements aluminum, titanium, niobium, cobalt, copper, molybdenum, tungsten and iron.

11. The spark plug of claim 1, wherein said first ground electrode carrier casing portion and said second ground electrode carrier casing portion are arranged along a longitudinal axis of said spark plug such that said second ground electrode carrier casing portion is axially closer to a combustion chamber of an engine than said first ground electrode carrier casing portion when said spark plug is installed in the engine.

12. A spark plug comprising:

an insulator body;

a spark plug casing enclosing said insulator body an outer surface of said spark plug casing forming a portion of an outer surface of said spark plug; and a ground electrode carrier casing having a screwthread on an outer surface thereof, said ground electrode carrier casing being made of a different material than said spark plug casing.

13. The spark plug of claim 12, wherein said ground electrode carrier casing has a higher thermal conductivity than said spark plug casing.

14. The spark plug of claim 12, wherein an entirety of said ground electrode carrier casing is in the form of a ring fitted onto or welded to said spark plug casing.

15. The spark plug of claim 12, wherein said ground electrode carrier casing carries a ground electrode.

16. The spark plug of claim 15, wherein said ground electrode carrier casing is integrally formed as one piece with said ground electrode.

17. The spark plug of claim 15, wherein said ground electrode is arranged substantially in an interior of said ground electrode carrier casing.

18. The spark plug of claim 17, wherein a wall of said ground electrode carrier casing surrounds said ground electrode, at least a portion of said wall has a surface inclined towards said ground electrode at an angle in a range of between 100 and 60° relative to a line parallel to a central electrode of said spark plug.

19. The spark plug of claim 12, wherein said ground electrode carrier casing comprises a nickel-based alloy or a nickel-chromium alloy.

20. The spark plug of claim 19, wherein said ground electrode carrier casing comprises said nickel-chromium alloy and further comprises at least one of the elements aluminum, titanium, niobium, cobalt, copper, molybdenum, tungsten and iron.

21. The spark plug of claim 12, wherein said ground electrode carrier casing has said screwthread formed over an entirety of an outer surface of said ground electrode carrier casing.

22. A spark plug comprising:

an insulator body;

a spark plug casing enclosing said insulator body; and a ground electrode carrier casing having a screwthread extending over substantially an entirety of an outer circumferential surface of said ground electrode carrier casing, said ground electrode carrier casing being made of a different material than said spark plug casing and being arranged so as to directly contact said spark plug casing.

23. The spark plug of claim 22, wherein said spark plug casing has an outer surface forming a portion of an outer surface of said spark plug.

24. The spark plug of claim 23, wherein said ground electrode carrier casing is directly welded to said spark plug casing.

25. The spark plug of claim 22, wherein said ground electrode carrier casing is directly welded to said spark plug casing.

* * * * *